US005567348A

United States Patent [19]

Nozawa et al.

[11] Patent Number: 5,567,348

[45] Date of Patent: Oct. 22, 1996

[54] DETERGENT COMPOSITION FOR PRECISION PARTS OR JIGS

[75] Inventors: Masanori Nozawa, Hannan; Eiji Kashihara, Wakayama, both of Japan

[73] Assignee: Kao Corporation, Tokyo, Japan

[21] Appl. No.: 395,654

[22] Filed: Feb. 28, 1995

Related U.S. Application Data

[63] Continuation of Ser. No. 50,669, Apr. 22, 1993, abandoned.

[30] Foreign Application Priority Data

Apr. 30, 1992 [JP] Japan ..... 4-111560

[51] Int. Cl.[6] ..... C11D 1/72; C11D 3/18; C11D 3/44; C23G 5/032

[52] U.S. Cl. ..... 510/175; 134/40; 510/245; 510/365

[58] Field of Search ..... 252/162, 170, 252/174.21, 173, 174.22; 134/40

[56] References Cited

U.S. PATENT DOCUMENTS

| | | | |
|---|---|---|---|
| 3,853,782 | 12/1974 | Chang | 252/139 |
| 4,859,359 | 8/1989 | DeMatteo et al. | 252/171 |
| 5,006,279 | 4/1991 | Grobbel et al. | 258/542 |
| 5,015,410 | 5/1991 | Sullivan | 252/166 |
| 5,096,504 | 3/1992 | Chihara et al. . | |
| 5,108,660 | 4/1992 | Michael | 252/156 |
| 5,171,475 | 12/1992 | Freiesleben | 252/312 |
| 5,207,838 | 5/1993 | Googin et al. | 252/153 |
| 5,213,624 | 5/1993 | Williams | 252/153 |
| 5,290,472 | 3/1994 | Michael | 252/170 |

FOREIGN PATENT DOCUMENTS

| | | |
|---|---|---|
| 0072488 | 2/1983 | European Pat. Off. . |
| 330379 | 8/1989 | European Pat. Off. . |
| 3-62896 | 3/1991 | Japan . |
| 3-97792 | 4/1991 | Japan . |
| 3-162496 | 7/1991 | Japan . |
| 4-59984 | 2/1992 | Japan . |
| 2247894 | 3/1992 | United Kingdom . |
| WO91/06690 | 5/1991 | WIPO . |
| WO93/02169 | 2/1993 | WIPO . |

OTHER PUBLICATIONS

*Grant & Hackh's Chemical Dictionary*5th Ed; edited by Grant Mc–Graw–Hill Book Co. NY 1987 (no month avail).

*Primary Examiner*—Linda Skaling Therkorn

*Attorney, Agent, or Firm*—Oblon, Spivak, McClelland, Maier & Neustadt, P.C.

[57] ABSTRACT

A detergent composition for precision parts or jigs includes (a) a hydrocarbon having a 10–18 carbon atoms,, (b) polyalkylene glycol $C_1$–$C_3$ alkyl ether, and (c) a polyalkylene glycol $C_4$–$C_8$ alkyl ether, wherein a weight ratio of component (a) to the sum of components (b) and (c), (a)/[(b)+(c)], is from 5/95 to 95/5, and a weight ratio of component (b) to component (c), (b)/(c), is from 5/95 to 95/5. The composition is excellent in removing smears such as fats and/or oils, machine oils, cutting oils, greases, liquid crystals, and/or rosin fluxes which have adhered to surfaces of precision parts or jigs. The present composition also exhibits excellent rinsability and high safety and is free of any fear of environmental pollution.

7 Claims, No Drawings

DETERGENT COMPOSITION FOR PRECISION PARTS OR JIGS

This application is a continuation of application Ser. No. 08/050,669, filed on Apr. 22, 1993, now abandoned.

BACKGROUND OF THE INVENTION

1. Field of the Invention

The present invention relates to a detergent composition for precision parts or jigs, and more specifically to a detergent composition exhibiting excellent ability to remove smears which have adhered to surfaces of precision parts or jigs, excellent rinsability, and high safety.

2. Description of the Background Art

Smears, comprising mainly organic substances such as fats and/or oils, machine oils, cutting oils, greases, liquid crystals and/or rosin fluxes, adhered to surfaces of precision parts or jigs used in assembling or processing have conventionally been removed with chlorinated solvents such as trichloroethylene and tetrachloroethylene; from solvents such as trichlorotrifluoroethane; water-based alkaline detergents having a surfactant and/or a builder incorporated into sodium orthosilicate or caustic soda, etc. However, chlorinated solvents and flon solvents introduce major problems Concerning their safety, toxicity, potential for environmental pollution, etc. On the other hand, when used to wash plastic or precision parts, the water-based alkaline detergents adversely affect such parts if they remain on the corresponding surfaces.

In recent years, glycol ethers (Japanese Laid-Open Patent Application Nos. 97792/1991 and 227400/1991), non-terpenic hydrocarbons (Japanese Laid-Open Patent Application No. 243699/1591), etc. have been proposed as such detergents. However, the glycol ethers do not effectively clean oil and fat smears, while the non-terpenic hydrocarbons exhibit poor rinsability.

There has hence been demand for development of a detergent composition which exhibits excellent ability to remove smears adhered on surfaces of precision parts or jigs, excellent rinsability, high safety and which is free of any fear of environmental pollution.

SUMMARY OF THE INVENTION

Accordingly, one object of the present invention is to provide a novel detergent composition for precision parts or jigs, exhibiting excellent detergency.

A further object of the present invention is to provide a novel detergent composition for precision parts or jigs, exhibiting excellent rinsability.

A further object of the present invention is to provide a novel detergent composition for precision parts or jigs, exhibiting high safety.

A further object of the present invention is to provide a novel detergent composition for precision parts or jigs, which is free of any fear of environmental pollution.

These and other objects, which will become apparent during the following detailed description of the preferred embodiments, are provided by the present invention, which in one aspect, provides a detergent composition for precision parts or jigs, comprising the following components (a) through (c):

(a) a hydrocarbon having a 10–18 carbon atoms;

(b) a glycol ether compound represented by the following general formula (1):

$$R^1—O—(C_nH_{2n}O)_m—R^2 \quad (1)$$

wherein $R^1$ means an alkyl group having 1–3 carbon atoms or an alkenyl group having 2 or 3 carbon atoms, $R^2$ denotes a hydrogen atom, an alkyl group having 1–3 carbon atoms or an alkenyl group having 2 or 3 carbon atoms, n is a number of from 2 to 4 and m is a number of from 1 to 4, with the proviso that radicals $C_nH_{2n}O$ may be different from each other if m is a number of from 2 to 4; and (c) a glycol ether compound represented by the following general formula (2):

$$R^3—O—(C_{n'}H_{2n'}O)_{m'}—R^4 \quad (2)$$

wherein $R^3$ means an alkyl or alkenyl group having 4–8 carbon atoms, $R^4$ denotes a hydrogen atom or an alkyl or alkenyl group having 4–8 carbon atoms, n' is a number of from 2 to 4 and m' is a number of from 1 to 4, with the proviso that radicals $C_{n'}$, $H_{2n'}$, O may be different from each other if m' is a number of from 2 to 4, wherein components (a), (b) and (c) are present in amounts providing a weight ratio of component (a) to the sum of components (b) and (c), (a)/[(b)+(c)], of from 5/95 to 95/5, and components (b) and (c) are present in a weight ratio of component (b) to component (c), (b)/(c), of from 5/95 to 95/5.

In another aspect, the present invention also provides a detergent composition for precision parts or jigs, which comprises components (a), (b) and (c) above, and further comprises components (d) and (e):

(d) a nonionic surfactant having an average hydrophile-lipophile balance ("HLB") of 4–18; and (e) water, wherein components (a), (b) and (c) are present in the amounts described above.

The detergent compositions for precision parts or jigs according to the present invention are excellent in removing smears such as fats and oils, machine oils, cutting oils, greases, liquid crystals, and rosin fluxes. Moreover, the present detergent compositions are high in safety and free of any fear of environmental pollution.

DETAILED DESCRIPTION OF THE PREFERRED EMBODIMENTS

The hydrocarbon of component (a) useful in the practice of the present invention may be any hydrocarbon having 10–18 carbon atoms, including alkanes, alkenes, alkynes, alkadienes, alkadiynes, alkatrienes, cycloalkanes, cycloalkenes and aromatic hydrocarbons. Further, noncyclic hydrocarbons may be linear or branched, and cyclic hydrocarbons may contain one or more alkyl, alkenyl or alkynyl groups. Examples thereof include linear or branched, saturated or unsaturated alkanes and alkenes, such as decane, dodecane, tetradecane, hexadecane, octadecane, decene, dodecene, tetradecene, hexadecene and octadecene; alkylbenzenes such as nonylbenzene and dodecylbenzene; naphthalene compounds such as methylnaphthalene and dimethylnaphthalene; alicyclic hydrocarbons such as cyclodecane and cyclododecene; etc. Of these, linear or branched, saturated or unsaturated hydrocarbons having 12–18 carbon atoms are preferred, with olefinic compounds being particularly preferred from the viewpoint of cleanability and handling properties. These hydrocarbons may preferably be incorporated in a proportion of 5–80% by weight (hereinafter indicated merely by %), particularly preferably 20–70% of the whole composition.

The glycol ether compound of component (b) is a compound represented by the general formula (1). In the general formula (1), $R^1$ is preferably an alkyl group having 1–3 carbon atoms, $R^2$ is preferably a hydrogen atom or an alkyl group having 1–3 carbon atoms, and n is preferably 2 or 3. Preferred examples of the glycol ether compound (1) include ethylene glycol monomethyl ether, ethylene glycol monoethyl ether, diethylene glycol monomethyl ether, diethylene glycol monopropyl ether, diethylene glycol dimethyl ether, diethylene glycol diethyl ether, diethylene glycol dipropyl ether, diethylene glycol methyl propyl ether, tri- or tetraethylene glycol ethers corresponding to these compounds, and di-, tri- or tetrapropylene glycol ethers corresponding to these compounds. Of these, diethylene glycol dimethyl ether, diethylene glycol diethyl ether, triethylene glycol dimethyl ether, triethylene glycol diethyl ether, tetraethylene glycol dimethyl ether and tetraethylene glycol diethyl ether are particularly preferred.

The glycol ether compound of component (c) is a compound represented by the general formula (2). In the general formula (2), $R^3$ is preferably an alkyl group having 4–6 carbon atoms, $R^4$ is preferably a hydrogen atom or an alkyl group having 4–6 carbon atoms, and n is preferably 2 or 3. Preferred examples of the glycol ether compound (2) include ethylene glycol monobutyl ether, ethylene glycol dibutyl ether, diethylene glycol monopentyl ether, diethylene glycol dipentyl ether, diethylene glycol monobutyl pentyl ether, diethylene glycol monohexyl ether, diethylene glycol dihexyl ether, diethylene glycol butylhexyl ether, diethylene glycol ethylhexyl ether, tri- or tetraethylene glycol ethers corresponding to these compounds, and di-, tri- or tetrapropylene glycol ethers corresponding to these compounds.

The glycol ether compound represented by the general formula (1) or (2) can be obtained, for example, by reacting an alkylene oxide (ethylene oxide, propylene oxide or butylene oxide) having 2–4 carbon atoms with an alcohol having 1–8 carbon atoms under heat in the presence of a basic catalyst, such as caustic soda, potassium hydroxide, or an alkali metal alkoxide salt (e.g., sodium methoxide, sodium ethoxide, sodium isopropoxide, potassium t-butoxide, etc.), caustic soda being preferred. In the reaction of the alkylene oxide with the alcohol, a random addition reaction may be conducted, in which two or more kinds of alkylene oxides are mixed and then reacted with the alcohol. Alternatively, a block addition reaction in which different alkylene oxides are added in sequence may be conducted. In addition, when the terminal hydroxyl group of the thus obtained alkylene oxide adduct is alkylated with an appropriate alkyl halide, alkyl arenesulfonate or the like (e.g., an alkyl chloride, alkyl bromide, alkyl iodide, alkyl benzenesulfonate or alkyl p-toluenesulfonate having from 1 to 8 carbon atoms in the alkyl group), its corresponding dialkyl ether can be obtained.

With respect to the glycol ether compounds obtained in the above described manner, m in the general formula (1) and m' in the general formula (2) each stand for a number of 1–4. Any numbers exceeding 4 are not preferable because the viscosity of the resulting composition increases, and the amount of the composition remaining after cleaning (e.g., before or during the rinse phase) increases. In the general formula (2), $R^3$ and $R^4$ mean individually an alkyl or alkenyl group having 4–8 carbon atoms. If the number of carbon atoms exceeds 8, the viscosity of the resulting composition increases, and its detergency and rinsability deteriorate.

Components (b) and (c) may be present in a combined proportion of 5–95%, preferably 10–70%, of the whole composition. The present detergent compositions are required to have a weight ratio of component (b) to component (c) (represented by the formula "(b)/(c)") of from 5/95 to 95/5, preferably from 10/90 to 90/10, and a weight ratio of component (a) to the sum of components (b) and (c) (represented by the formula "(a)/[(b)+(c)]") of from 5/95 to 95/5, preferably from 25/75 to 75/25. Any weight ratios outside these ranges result in a detergent composition having insufficient cleanability and rinsability.

The detergent composition according to the first aspect of the present invention displays an excellent ability to dissolve organic smears. However, its solubility in water decreases as the amount of component (a) in the composition increases. There is hence a potential problem that a failure in rinsing with water may occur. Since the present detergent composition has low solubility in water, its stability as a product may decrease in the presence of water. In such a case, it is necessary only to add a nonionic surfactant having an average HLB of 4–18 to the detergent composition. The addition of such a surfactant can improve the stability of the present detergent composition in the presence of water, and thus, provides the detergent composition according to the second aspect of the present invention.

The term "HLB" for polyalkylene oxide surfactants, means the weight percentage of alkylene oxide in the polyalkylene oxide-based molecule divided by 5. On the other hand, for non-polyalkylene oxide surfactants, "having an HLB of 4–18" means having an equivalent ability to emulsify a particular mixture of oil and water as a polyalkylene oxide surfactant having an HLB of 4–18.

Preferred nonionic surfactants for use as component (d) include polyoxyalkylenes and ethers and esters thereof, such as polyoxyalkylene alkyl ethers, polyoxyalkylene alkyl phenol ethers, polyoxyalkylene alkyl fatty acid esters, polyoxyalkylene allyl phenol ethers, polyoxyalkylene sorbitan fatty acid esters, polyoxyalkylene alkylamines, sorbitan fatty acid esters, polyoxyethylenes, polyoxypropylenes, polyoxybutylenes, polyoxyethylene-polyoxypropylene copolymers, and the like. The term "polyoxyalkylene" as used herein means a polymer of ethylene oxide, propylene oxide and/or butylene oxide. The term "fatty acid" as used herein means a carboxylic acid of from 8 to 24 carbon atoms, which may be saturated or unsaturated. Of the preferred nonionic surfactants above, polyoxyalkylene oleyl ethers provide the most effective results.

The nonionic surfactant is preferably incorporated in a proportion of 0.5–35%, particularly 3–30%, of the whole composition. Proportions exceeding 35% are not preferable because the viscosity of the resulting composition increases.

The detergent composition according to the second aspect of the present invention may contain water in a suitable amount, from the viewpoints of safety and workability. Water is preferably incorporated in a proportion of 5–30% into the detergent composition.

In the present detergent compositions, other additives such as surfactants, antifoaming agents such as silicone, amine- or phenol-type antioxidants, rust preventives, alkanolamines and the like may be optionally incorporated in any suitable amounts, as long as their addition does not impede the advantageous effects of the present detergent compositions.

The present detergent compositions can be prepared by mixing components (a)–(c) or components (a)–(e) and/or the optional components in accordance with methods known per se in the art.

An efficient method of cleaning precision parts or jigs with the present detergent composition includes, for example, a method comprising dipping the precision part or jig into the present detergent composition, optionally while irradiating with ultrasound. Subsequently, final rinsing with a solvent or hot water may be conducted. The cleaning may be carried out using various kinds of cleaning processes, such as vibration processes and spray processes.

Other features of the invention will become apparent in the course of the following descriptions of exemplary embodiments which are given for illustration of the invention, and are not intended to be limiting thereof.

EXAMPLES

EXAMPLE 1

Detergent compositions having the compositions shown in Tables 1 and 2 were prepared in accordance with a method known per se in the art. The ability to remove smears (detergency) and rinsability of the detergent compositions thus obtained were evaluated by the following methods. The results are shown in Tables 1 and 2.

Evaluation Methods

Ten printed circuit boards treated with a rosin flux, ten copper plates coated with a naphthenic mineral oil and ten glass substrates coated with a nematic liquid crystal were immersed in each of the detergent compositions at 40° C. for 3 minutes, while simultaneously applying ultrasonic waves. At this time, the ability of each detergent composition to remove smears was evaluated. The printed circuit boards, copper plates and glass substrates, which had been washed with each detergent composition, were then rinsed with deionized water at 40° C. to evaluate with the naked eye the rinsability of the detergent composition. The standards for evaluating the ability to remove smears and rinsability are as follows:

Ability to Remove Smears:

○: No smears (flux, naphthenic mineral oil or liquid crystal) remained (very good)

○: Smears scarcely remained (good)

ΔSmears slightly remained (somewhat poor)

x: Smears considerably remained (poor)

Rinsability:

○: Very good

○: Good

Δ: Somewhat poor x: Poor

Obviously, numerous modifications and variations of the present invention are possible in light of the above teachings. It is therefore to be understood that within the scope of the appended claims, the invention may be practiced otherwise than as specifically described herein.

TABLE 1

| Component (%) | | Inventive composition 1 | 2 | 3 | 4 | 5 | 6 |
|---|---|---|---|---|---|---|---|
| Tetradecane | | 40 | | | 30 | | |
| Tetradecene | | | 52 | | | | 60 |
| Dimethylnaphthalene | | | | 50 | | 50 | |
| $C_2H_5O(C_3H_6O)(C_2H_4O)_2H$ | | 15 | | 3 | | 5 | |
| $C_2H_5O(C_2H_4O)_2C_2H_5$ | | | 10 | | 20 | | 15 |
| $C_2H_5O(C_2H_4O)_2(C_3H_6O)CH_3$ | | 5 | | 7 | 10 | 5 | |
| $C_4H_8O(C_2H_4O)_2H$ | | 10 | | 5 | | | |
| $C_6H_{13}O(C_2H_4O)_2H$ | | | 18 | | 5 | | 15 |
| $C_4H_9O(C_2H_4O)_3C_4H_9$ | | | | 7 | 8 | 15 | |
| Polyoxyethylene nonyl phenol ether (Average HLB = 8) | | 15 | | | 5 | 11 | |
| Polyoxyethylene dodecyl ether (Average HLB = 10.5) | | | | 8 | | 4 | |
| Polyoxyethylene oleyl ether (Average HLB = 11) | | | 13 | | 5 | | 10 |
| Polyoxyethylene sorbitan trioleate (Average HLB = 11) | | | | 7 | | | |
| Water | | 15 | 7 | 13 | 17 | 10 | |
| | Evaluation | | | | | | |
| Ability to remove smears | Flux | ◎ | ◎ | ◎ | ◎ | — | ◎ |
| | Naphthenic mineral oil | — | ◎ | ◎ | ◎ | ◎ | ◎ |
| | Liquid crystal | ◎ | ◎ | ◎ | — | ◎ | ◎ |
| Rinsability | | ◎ | ◎ | ◎ | ◎ | ◎ | ◎ |

TABLE 2

| Component (%) | Comparative composition 1 | 2 | 3 | 4 | 5 | 6 |
|---|---|---|---|---|---|---|
| Tetradecane | | | 100 | | | 80 |
| Tetradecene | | | | 100 | | |
| Dimethylnaphthalene | | | | | 100 | |
| $C_2H_5O(C_3H_6O)(C_2H_4O)_2H$ | 100 | | | | | |
| $C_2H_5O(C_2H_4O)_2C_2H_5$ | | 20 | | | | |
| $C_2H_5O(C_2H_4O)_2(C_3H_6O)CH_3$ | | 20 | | | | |
| $C_4H_9O(C_2H_4O)_2H$ | | | | | | |
| $C_6H_{13}O(C_2H_4O)_2H$ | | 40 | | | | |
| $C_4H_9O(C_2H_4O)_3C_4H_9$ | | | | | | |
| Polyoxyethylene nonyl phenol ether (Average HLB = 8) | | | | | | 20 |
| Polyoxyethylene dodecyl ether (Average HLB = 10.5) | | 20 | | | | |
| Polyoxyethylene oleyl ether (Average HLB = 11) | | | | | | |
| Polyoxyethylene sorbitan trioleate (Average HLB = 11) | | | | | | |

TABLE 2-continued

| Component (%) | | Comparative composition 1 | 2 | 3 | 4 | 5 | 6 |
|---|---|---|---|---|---|---|---|
| Water | | | | | | | |
| | Evaluation | | | | | | |
| Ability to remove smears | Flux | x | ○ | ⊙ | — | ⊙ | ⊙ |
| | Naphthenic mineral oil | x | x-Δ | — | ⊙ | ⊙ | — |
| | Liquid crystal | x | x-Δ | ⊙ | ⊙ | ⊙ | ⊙ |
| Rinsability | | ⊙ | ⊙ | x | x | x | Δ-x |

What is claimed is:

1. A detergent composition for precision parts of jigs, which comprises:

(a) from 20 to 70% by weight of the composition of a hydrocarbon having 10–18 carbon atoms;

from 10 to 70% by weight of the composition of a mixture of the following components (b) and (c):

(b) a glycol ether compound represented by the following formula (1):

$$R—O—(C_nH_{2n}O)_m—R^2 \quad (1)$$

wherein $R^1$ means an alkyl group having 1–3 carbon atoms, $R^2$ denotes a hydrogen atom or an alkyl group having 1–3 carbon atoms, n is 2 or 3 and m is 2 or 3, with the proviso that radicals $C_nH_{2n}O$ may be different from each other;

(c) a glycol ether compound represented by the following formula (2):

$$R^3—O—(C_{n'}\ H_{2n'}O)_{m'}\ —R^4 \quad (2)$$

wherein $R^3$ means an alkyl group having 4–8 carbon atoms, $R^4$ denotes a hydrogen atom or an alkyl group having 4–8 carbon atoms, n' is 2 or 3 and m' is 2 or 3, with the proviso that radicals $C_{n'}H_{2n'}O$ may be different from each other; and (d) from 3 to 30% by weight of a non-ionic surfactant selected from the group consisting of polyoxyethylene alkyl ethers, polyoxyethylene alkyl phenol ethers and polyoxyethylene sorbitan fatty acid esters, said alkyl having from 9 to 18 carbon atoms and said fatty acid having from 9 to 24 carbon atoms;

wherein components (a), (b) and (c) are present in amounts such that the ratio of the weight of component (a) to the sum of the weights of components (b) and (c), (a)/[(b)+(c)], is from 25/75 to 75/25, and the weight ratio of component (b) to component (c), (b)/(c), is from 5/9 to 30/13.

2. The detergent composition of claim 1, wherein said component (a) is an olefinic hydrocarbon having 12–18 carbon atoms.

3. The detergent composition of claim 1, wherein component (d) is a polyoxyalkylene oleyl ether.

4. The detergent composition of claim 1, further comprising from 5 to 30% by weight of water.

5. The detergent composition of claim 1, wherein said hydrocarbon is an alkane, alkene or a naphthalene compound having 12–18 carbon atoms.

6. The composition of claim 1, wherein said non-ionic surfactant (d) is present in an amount of from 10 to 15% by weight of the composition.

7. The composition of claim 1, wherein $R^1$ is an alkyl group having one or two carbon atoms, $R^2$ is a hydrogen atom or an alkyl group having one or two carbon atoms, $R^3$ is an alkyl group having 4–6 carbon atoms, $R^4$ is a hydrogen atom or an alkyl group having 4–6 carbon atoms, and said non-ionic surfactant (d) has an HLB of from 8 to 11.

* * * * *